US011116259B1

(12) United States Patent
Barrett

(10) Patent No.: US 11,116,259 B1
(45) Date of Patent: Sep. 14, 2021

(54) CLOTHING ARTICLE FOR BREAST SUPPORT WITH REMOVABLE UNDERWIRE

(71) Applicant: Chereese Barrett, Baltimore, MD (US)

(72) Inventor: Chereese Barrett, Baltimore, MD (US)

( * ) Notice: Subject to any disclaimer, the term of this patent is extended or adjusted under 35 U.S.C. 154(b) by 0 days.

(21) Appl. No.: 17/090,297

(22) Filed: Nov. 5, 2020

Related U.S. Application Data

(60) Provisional application No. 63/026,844, filed on May 19, 2020.

(51) Int. Cl.

| | |
|---|---|
| ***A41C 3/00*** | (2006.01) |
| ***A41C 3/14*** | (2006.01) |
| ***A41C 3/06*** | (2006.01) |
| ***A41F 15/00*** | (2006.01) |
| ***A41C 3/12*** | (2006.01) |
| ***A41C 3/10*** | (2006.01) |

(52) U.S. Cl.
CPC ..... *A41C 3/0007* (2013.01); *A41C 3/06* (2013.01); *A41C 3/10* (2013.01); *A41C 3/128* (2013.01); *A41F 15/002* (2013.01); *A41C 3/144* (2013.01)

(58) Field of Classification Search
CPC ..... A41C 3/0007; A41C 3/14; A41C 3/10
USPC ..... 450/52
See application file for complete search history.

(56) References Cited

U.S. PATENT DOCUMENTS

| | | | | |
|---|---|---|---|---|
| 2,613,365 | A | 10/1952 | Lee et al. | |
| 3,306,299 | A * | 2/1967 | Paramore | A41C 3/0007 450/81 |
| 5,749,767 | A * | 5/1998 | Arceo | A41C 3/126 2/255 |
| 5,908,346 | A | 6/1999 | McCall | |
| 5,967,876 | A * | 10/1999 | Kollmanthaler | A41C 3/124 450/41 |
| 6,319,092 | B1 * | 11/2001 | Leyhe | A41C 3/0071 450/36 |
| 6,425,799 | B1 | 7/2002 | Pai | |
| 6,439,960 | B1 | 8/2002 | Fildan et al. | |
| 6,447,365 | B1 | 9/2002 | Powell et al. | |
| 10,918,139 | B2 * | 2/2021 | Toth | A41C 3/126 |

* cited by examiner

*Primary Examiner* — Timothy K Trieu
(74) *Attorney, Agent, or Firm* — Boudwin Intellectual Property; Daniel Boudwin

(57) ABSTRACT

A clothing article for breast support is shown and described. The clothing article for breast support with removable underwire includes a front portion having two breast support sections. At least one underwire is removably secured around a lower perimeter of each of the two breast support sections, wherein the underwire is a single piece. A strap system is secured to the top of each of the breast support sections. The strap system is further secured to a side of each breast support, wherein the straps are connected to opposite sides of each breast support section.

9 Claims, 9 Drawing Sheets

CLOTHING ARTICLE FOR BREAST SUPPORT WITH REMOVABLE UNDERWIRE

CROSS REFERENCE TO RELATED APPLICATIONS

This application claims the benefit of U.S. Provisional Application No. 63/026,844 filed on May 19, 2020. The above identified patent application is herein incorporated by reference in its entirety to provide continuity of disclosure.

BACKGROUND OF THE INVENTION

The present invention relates to a breast support clothing article. More particularly, the present invention provides a breast support clothing article with a removable underwire.

Many individuals wear bras or bathing suits to cover and support breasts. These articles may come in various styles and are made from various materials. One item that is the same across all styles and materials is an underwire. An underwire is a section of metal material that is rigid and helps the article hold its shape. This will allow for the article to add support the breasts.

As the articles are used and washed, the underwires have a tendency to become uncomfortable. This is a result of the underwire wearing away at the padding around the underwire. This leads to a shortened life of the article. In other instances, the underwire may poke through the lining of the material. This can cause discomfort at the least. In other situations, the underwire may ruin the article by poking through the front of the article.

Consequently, there is a need for an improvement in the art of breast support clothing articles. The present invention substantially diverges in design elements from the known art while at the same time solves a problem many people face when washing clothing articles with underwires therein. In this regard the present invention substantially fulfills these needs.

SUMMARY OF THE INVENTION

The present invention provides a clothing article for breast support with removable underwire wherein the same can be utilized for providing convenience for the user when using a clothing article for breast support with removable underwire. The clothing article for breast support with removable underwire comprises a front portion having two breast support sections. At least one underwire is removably secured around a lower perimeter of each of the two breast support sections, wherein the underwire is a single piece. A strap system is secured to the top of each of the breast support sections. The strap system is further secured to a side of each breast support, wherein the straps are connected to opposite sides of each breast support section.

Another object of the clothing article for breast support with removable underwire is to provide at least one underwire that is made from metal.

Another object of the clothing article for breast support with removable underwire is to provide at least one underwire that is made from plastic.

Another object of the clothing article for breast support with removable underwire is to provide at least one underwire which is secured in a tube located along the lower perimeter of each breast support section, and wherein the tube has at least one open end.

Another object of the clothing article for breast support with removable underwire is to provide at least one underwire which is secured in a tube located along the lower perimeter of each breast support section, and wherein the tube is held closed via a hook and loop fastener.

Another object of the clothing article for breast support with removable underwire is to provide at least one underwire which is secured in a tube located along the lower perimeter of each breast support section, and wherein the tube is held closed with a zipper.

Another object of the clothing article for breast support with removable underwire is to provide adjusters located on the strap system.

Another object of the clothing article for breast support with removable underwire is to provide a strap system which is removably connected to the breast support sections.

Another object of the clothing article for breast support with removable underwire is to provide a padding located within each breast support section.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
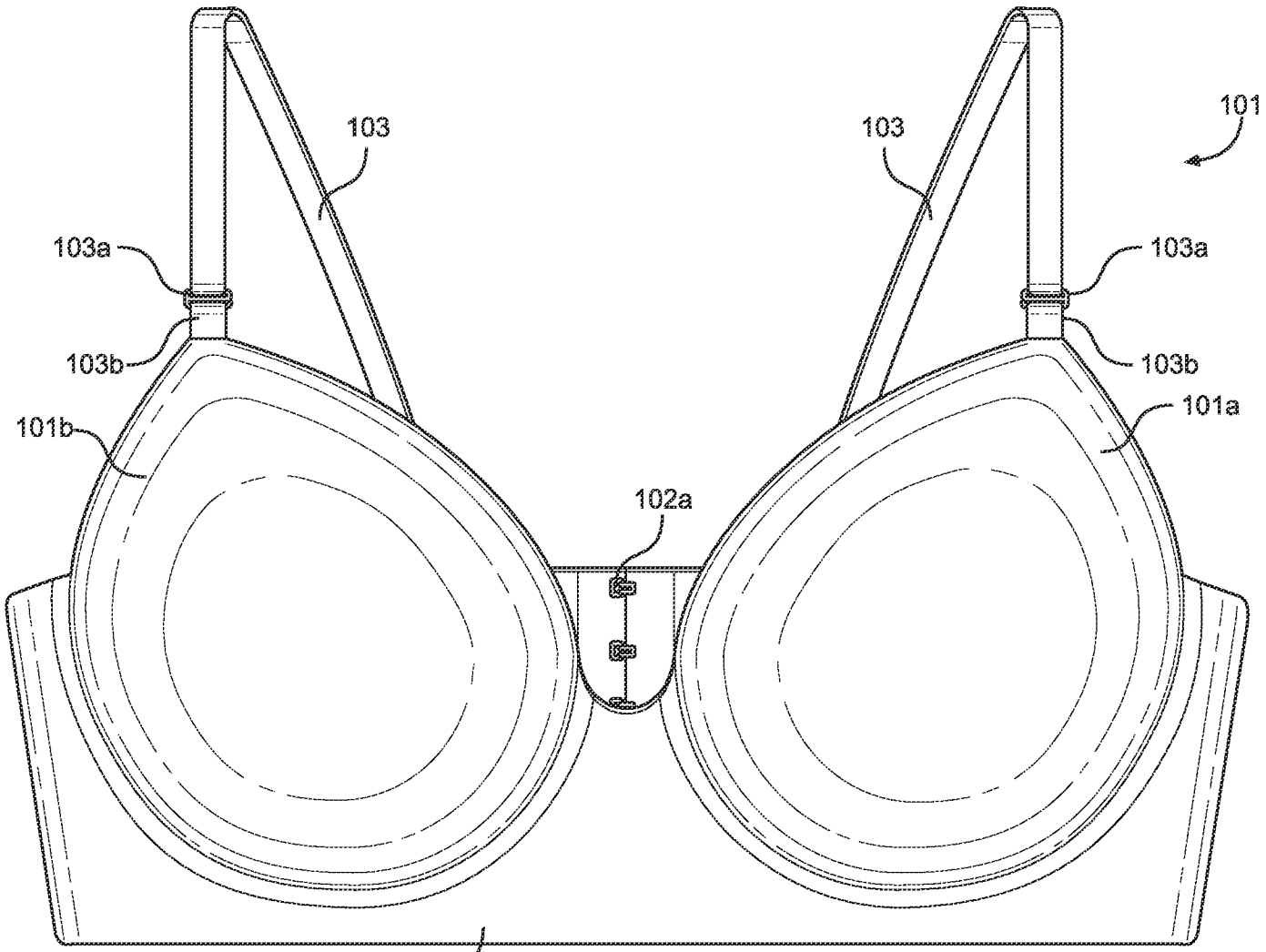
FIG. 1 shows a front view of one embodiment of the clothing article for breast support with removable underwire.

With regard to the reference numerals used, the following numbering is used throughout the drawings.

101 Front portion
101*a* Breast portion
101*b* Breast portion
102 Chest strap

102*a* Clasp
103 Shoulder strap
103*a* Hook
103*b* Loop
201 Separate underwire
202 Single underwire
203 Connection point
301 Tube
301*a* Tube ends
302 Tube opening
303 Zipper closure
304 Hook and loop closure
305 Pads
306 Pad pockets
601 Flap
602 Female snap portion
603 Male snap portion
604 Adjuster
701 Underwire snap connection

DETAILED DESCRIPTION OF THE INVENTION

Reference is made herein to the attached drawings. Like reference numerals are used throughout the drawings to depict like or similar elements of the clothing article for breast support with removable underwire. For the purposes of presenting a brief and clear description of the present invention, a preferred embodiment will be discussed as used for the clothing article for breast support with removable underwire. The figures are intended for representative purposes only and should not be considered to be limiting in any respect.

Referring now to FIG. 1, there is shown a front view of one embodiment of the clothing article for breast support with removable underwire. The clothing article may come in many different embodiments. In one embodiment, the clothing article has a front portion 101. The front portion 101 is comprised of two breast portions 101*a*, 101*b*. Each breast portion 101*a*, 101*b* is shaped to support and secure a human breast. In one embodiment, each breast portion 101*a*, 101*b* includes a padding to allow for greater comfort. The padding will be described in detail in FIG. 3 and FIG. 4.

In one embodiment the front portion 101 is made from cotton. In another embodiment the front portion 101 is made from satin. In yet a further embodiment the front portion 101 is made from brocade. In another embodiment the front portion 101 is lined with muslin. In one embodiment the front portion 101 is lined with a power mesh. The power mesh will add additional support.

In one embodiment each breast portion is has a polyester boning along the top perimeter. Each breast portion 101*a*, 101*b*, is secured to a chest strap 102. In one embodiment, the chest strap 102 is an elastic strap. In another embodiment, the chest strap 102 is a length of cord. In yet a further embodiment, the chest strap 102 is a length of material. In one embodiment, the chest strap 102 is a continuous strap. In another embodiment, the chest strap 102 is secured together via a separable clasp 102*a*. In yet a further embodiment the chest strap 102 is secured by tying the ends together.

In one embodiment, the chest strap 102 is the sole means of securing the clothing article to a user. In one embodiment the chest strap 102 is made from stretch lace. In another embodiment the chest strap is made from other fabrics 102. In another embodiment, the chest strap 102 is part of a strap system that includes the chest strap 102 and two shoulder straps 103. Each shoulder strap 103 is secured to a breast portion 101*a*, 101*b* at one end of the shoulder strap 103. In one embodiment the shoulder straps 103 are made from elastic. In one embodiment the shoulder straps are adjustable using adjustment rings. In one embodiment, each shoulder strap 103 is further secured to a section of the chest strap 102 at an opposite end of the shoulder strap 103. In another embodiment, the shoulder straps 103 will connected together at the opposite end behind a wearer's neck. This will allow the shoulder straps 103 to prevent the article from sliding down a wearer.

In one embodiment, the shoulder straps 103 are removably secured to the article. In one embodiment, there are loops 103*b* located on the chest strap 102 and at a top of each breast portion 101*a*, 101*b*. Each shoulder strap 103 has a hook 103*a* located at each end. The hooks 103*a* will secure to the loops 103*b* and allow the shoulder straps 103 to be removably connected to the article.

In different embodiments, the article is meant for different purposes. In one embodiment, the article is a bathing suit. In this embodiment, the material is made from a sun resistant material that is made to be submerged in water for extended periods of time. In another embodiment, the article is a sports article of clothing. In this embodiment, the material is made from a soft moisture wicking material. In other embodiments, the article is intended to be one of various types of under garments. In these embodiments, different manners of materials may be used such as cotton, silk, satin, barcode, and muslin. In one embodiment, the article is decorated with lace. In one embodiment the midriff includes stretch lace. In one embodiment there are elastic straps. In another embodiment there are inelastic straps. In another embodiment, the article is incorporated into a larger piece of clothing. In another embodiment the article is strapless. In one embodiment there is a polyester lining within the article.

Figure 2A:
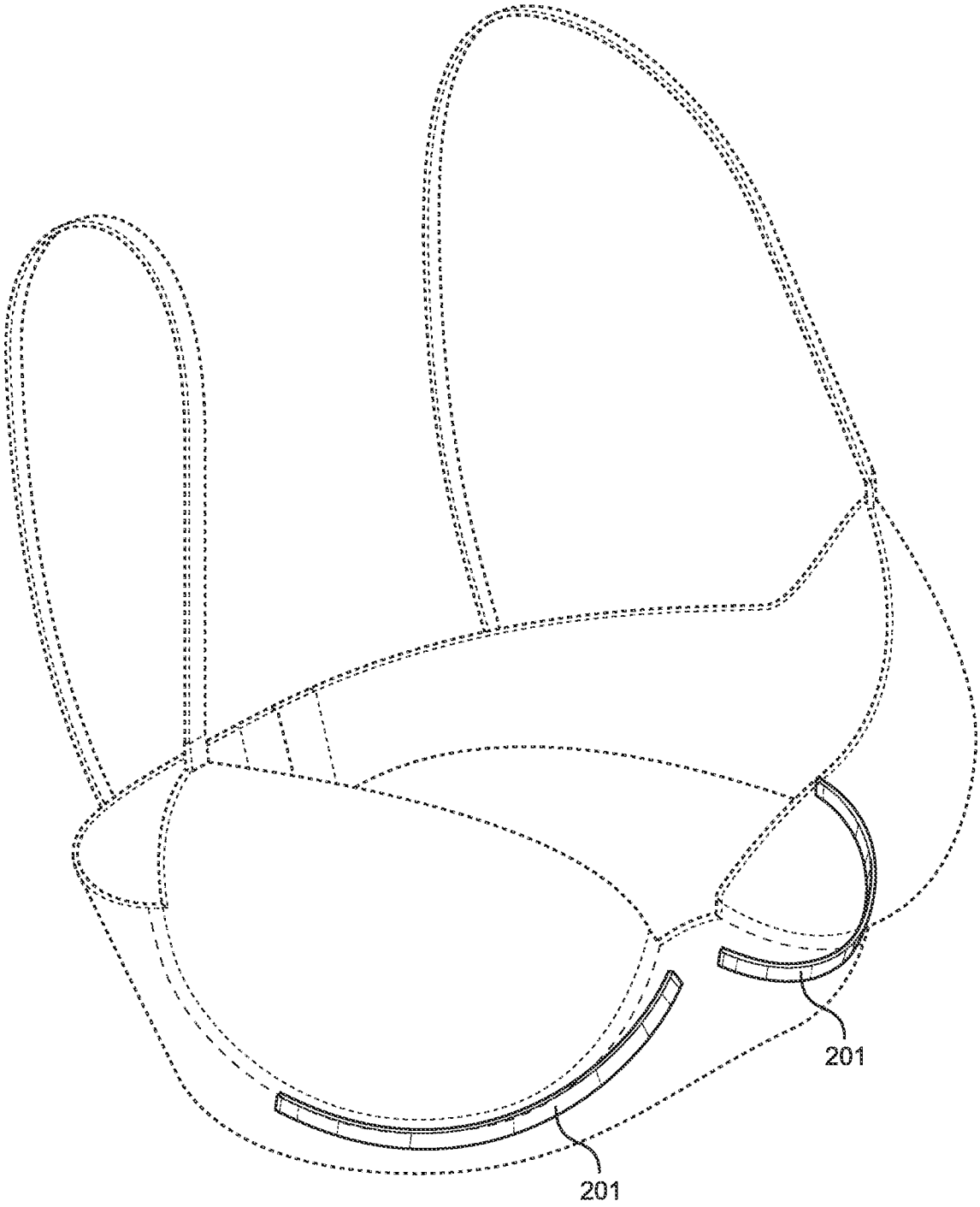
FIG. 2A shows a perspective view of an embodiment of the underwire for the clothing article for breast support with removable underwire.
Figure 2B:
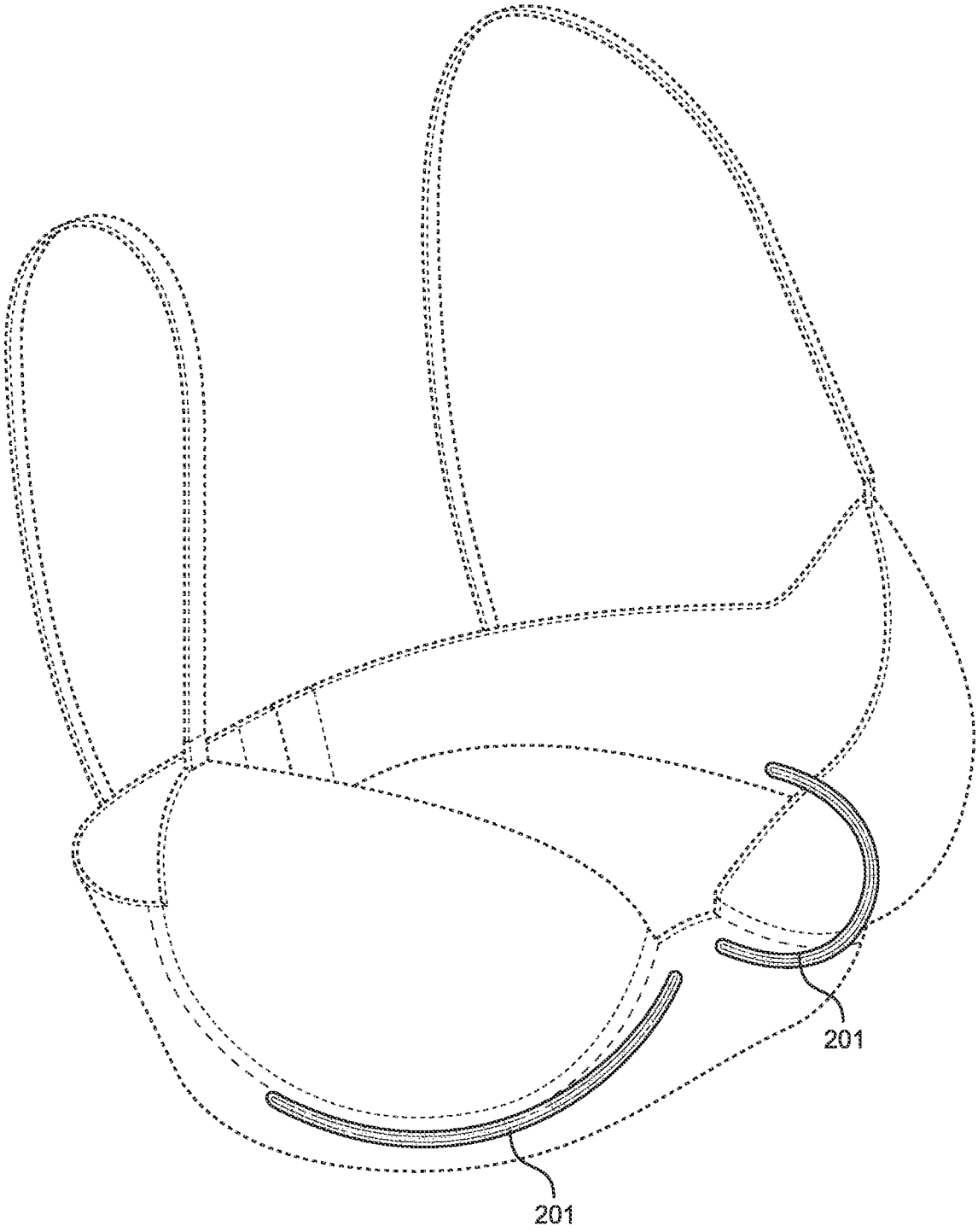
FIG. 2B shows a perspective view of an embodiment of the underwire for the clothing article for breast support with removable underwire made from an alternative material.
Figure 2C:
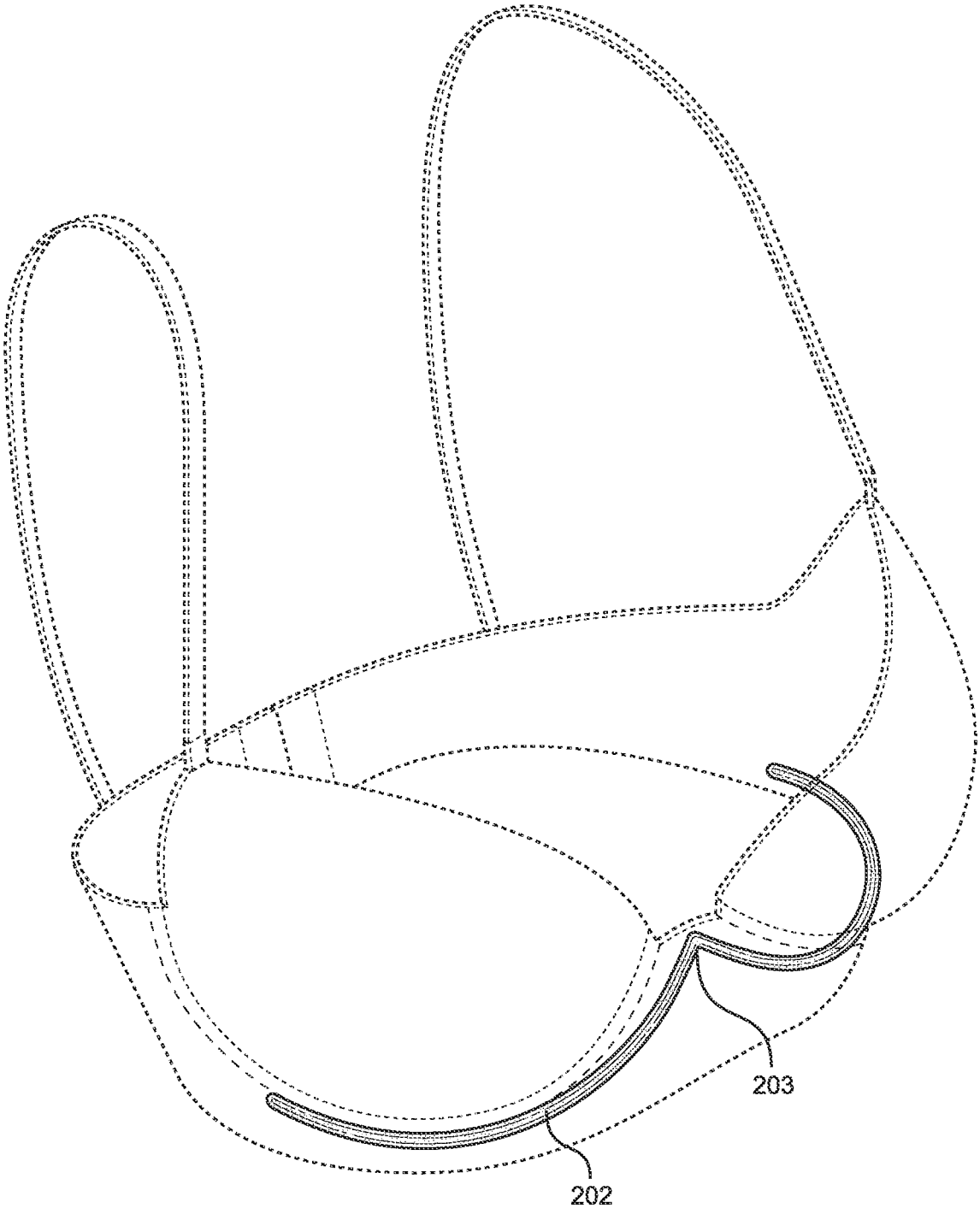
FIG. 2C shows a perspective view of an embodiment of the underwire for the clothing article for breast support with removable underwire in a one-piece configuration.

Referring now to FIG. 2A, FIGS. 2B, and 2C, there is shown a perspective views of an embodiments of underwire for the clothing article for breast support with removable underwire. In different embodiments, there are different underwires meant for use in the clothing article for breast support with removable underwire. In one embodiment, there are two underwires 201; one for each breast portion. In another embodiment, there is a single underwire 202. In either embodiment, the underwire 201, 202 will ensure that the breast portion holds its shape. Further, the underwire 201, 202 will help support the breasts by preventing the material from being moved out of position by the weight of a breast. The underwires 201, 202 will ensure that the clothing article supports the breasts in a proper place.

In the embodiments where there are two separate underwires 201, each underwire 201 shall have a curve. In this embodiment, the underwire 201 will curve in a crescent shape. This will allow the underwire to match the contour of the underside of a breast. In the embodiments where there is a single underwire 202, there will be two crescent shaped curves have with a connection point 203 at an interior end of each crescent. In one embodiment, the connection 203 will form a point. In another embodiment, the connection 203 is a line to allow the crescents to be slightly separated. This will allow for a better fit of larger breasts.

In various embodiments, the ends of the underwire 201, 202, are blunted. This will better ensure the underwire 201, 202 does not puncture the clothing article when worn. In one embodiment, the underwire 201, 202, is made from a metal material. This will ensure maximum support. In another embodiment, the underwire, 201, 202 is made from plastic.

This will ensure support will minimizing the chance that the underwire 201, 202 punctures the clothing article while worn.

Figure 3:
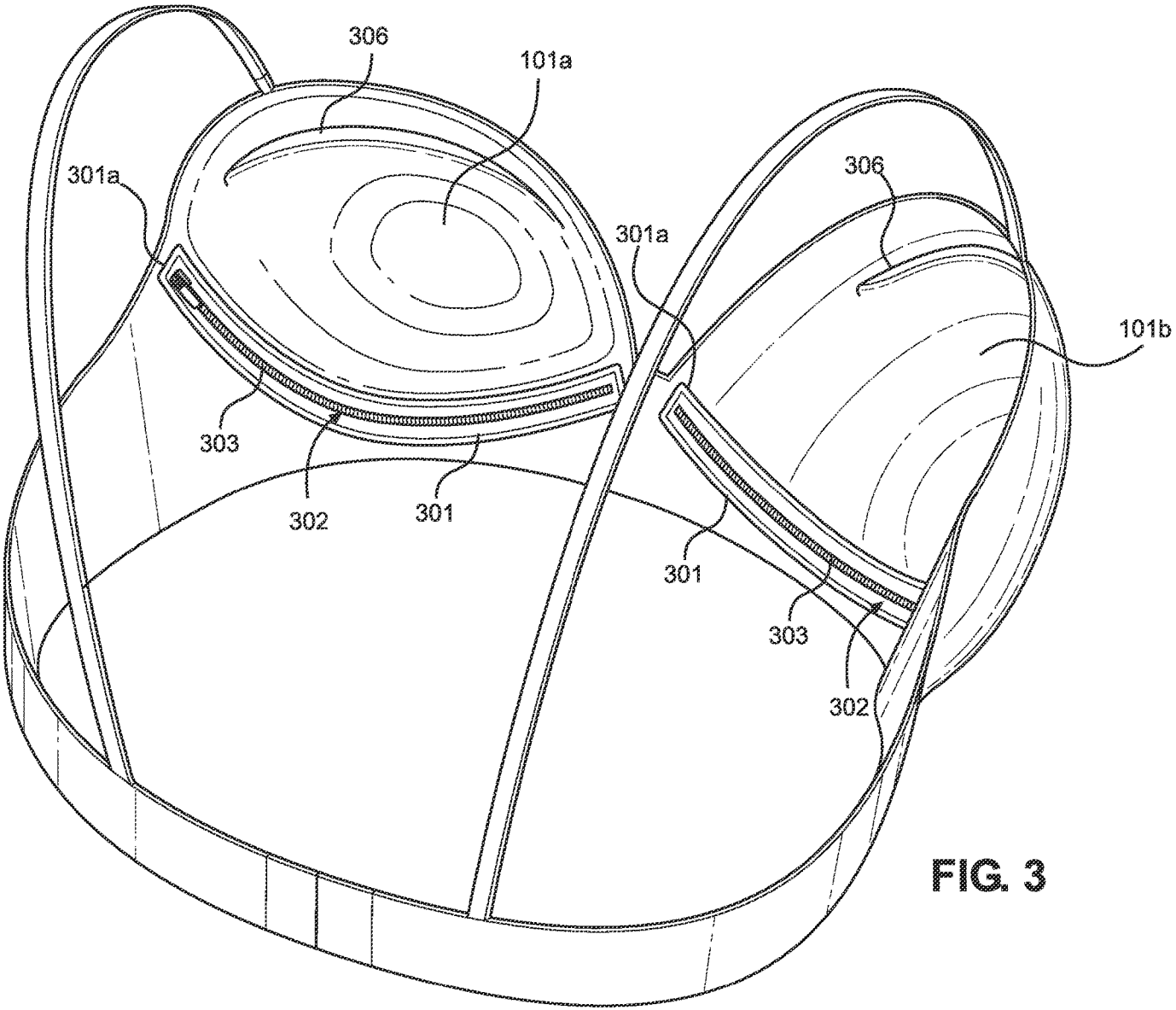
FIG. 3 shows a rear perspective view of an embodiment of the clothing article for breast support with removable underwire with tube for the underwire with a zipper.
Figure 4:
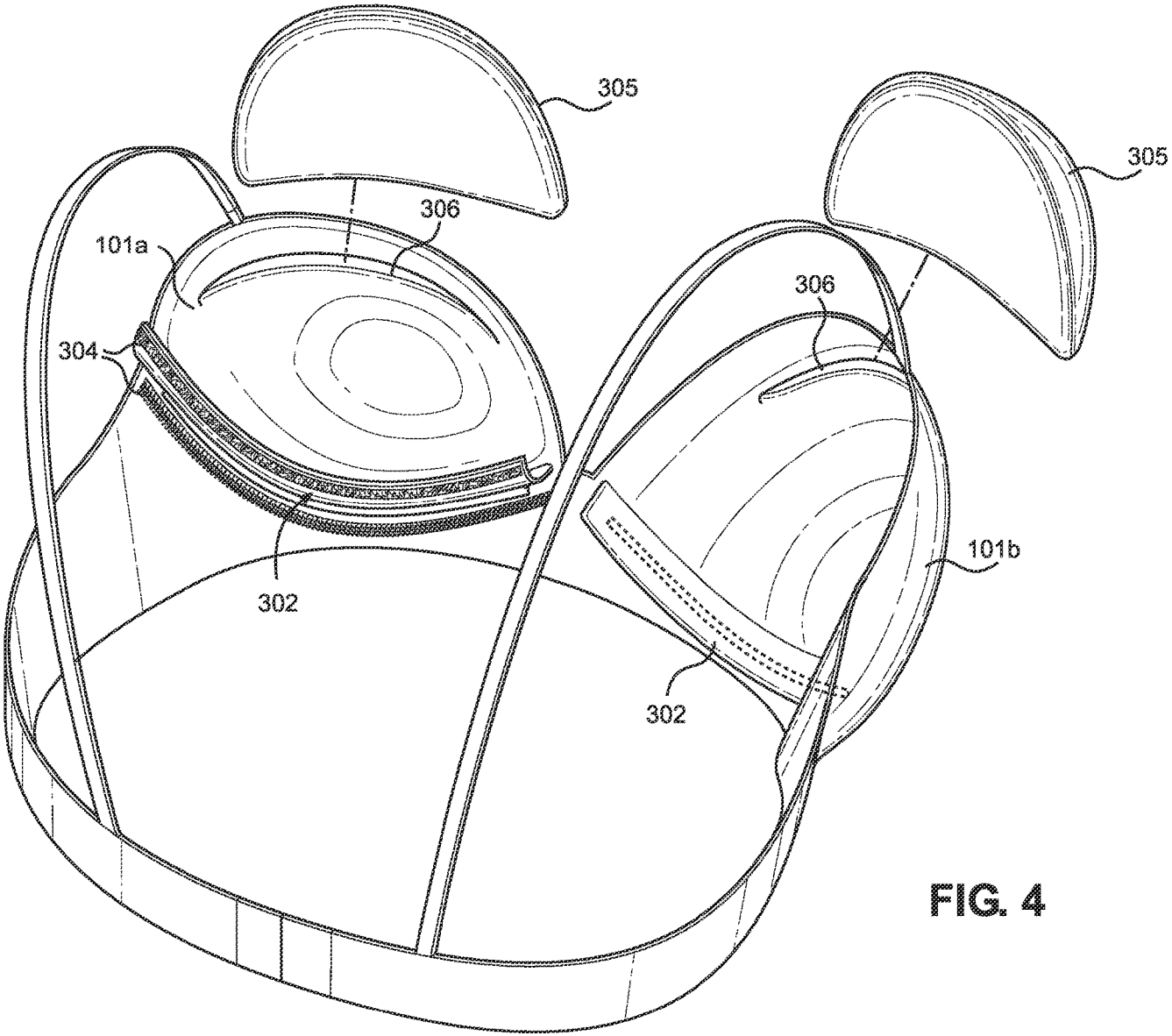
FIG. 4 shows a rear perspective view of an embodiment of the clothing article for breast support with removable underwire with tube for the underwire with a Velcro closure.
Figure 5:
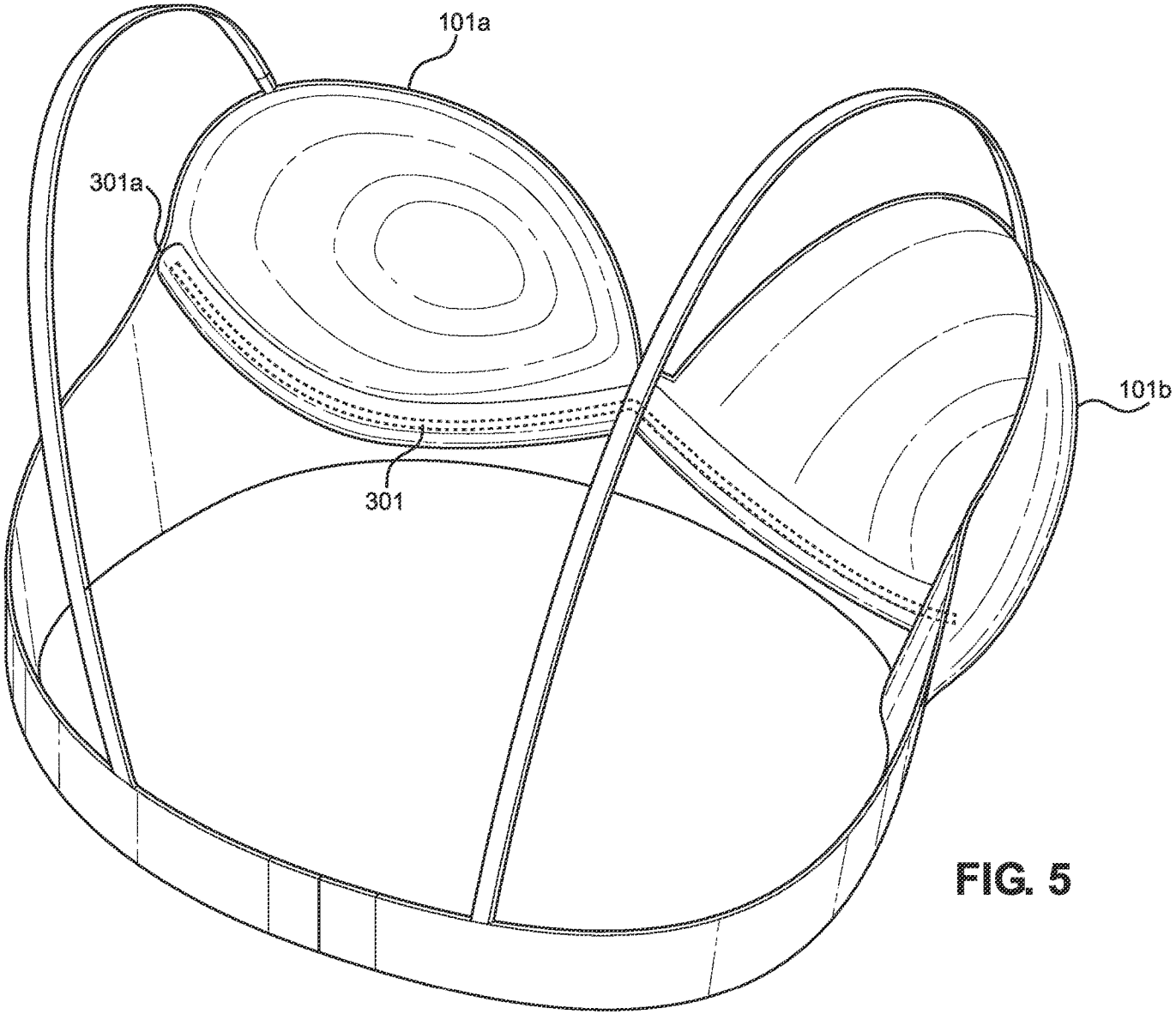
FIG. 5 shows a rear perspective view of an embodiment of the clothing article for breast support with removable underwire with tube for the underwire with a tube and opening at both ends.

Referring now to FIG. 3 and FIG. 4, there is shown a rear perspective views of an embodiment of the clothing article for breast support with removable underwire with tube for the underwire with and a closure. In one embodiment, there is a tube 301 located at the base of each breast portion 101*a*, 101*b*. The tube 301 will removably receive at least one underwire. In the shown embodiments, there are two tubes 301; one under each breast portion 101*a*, 101*b*. In another embodiment, as shown in FIG. 5, there is a single tube 301 that is located under each breast portion 101*a*, 101*b* and is connected in between. It should be noted that while different embodiments are shown, it is contemplated that each feature may be used in combination with each tube 301 type.

In one embodiment, each tube 301 is closed at the ends 301*a*. In this embodiment there is an opening 302 running along the length of each tube 301. This opening 302 is selectively closable via a closure device. In different embodiments, different closure devices are used. In one embodiment, the closure device is a zipper 303. The zipper 303 will ensure that the opening 302 remains closed. Further, the zipper 303 is flexible. In other embodiments, a hook and loop closure 304 is used. Hook and loop closures 304 will have a longer life than zippers 303. Further, hook and loop closures 304 will not accidentally snag a wearer's skin.

In various embodiments, the clothing article has pads 305 included in each breast portion 101*a*, 101*b*. In one embodiment, the pads 305 are removably secured within pockets 306 of the breast portions 101*a*, 101*b*. In another embodiment, the pads 305 are secured within the breast portions 101*a*, 101*b*. In one embodiment, the pads 305 are used for comfort. In another embodiment, the pads 305 are used to help add shape and support to the clothing article.

Referring now to FIG. 5, there is shown a rear perspective view of an embodiment of the clothing article for breast support with removable underwire with tube for the underwire with a tube and opening at both ends. In a further embodiment, there is a single tube 301 located at the base of both breast portions 101*a*, 101*b*. This tube 301 will connect in the middle between the breast portions 101*a*, 101*b*. This will allow for a single underwire to be placed therein. In one embodiment, there is no opening along the length of the tube 301. In this embodiment, at least one end 301*a* of the tube 301 is open. In one embodiment, the opening has an elastic device that prevents the underwire from accidentally protruding through the opening.

Figure 6:
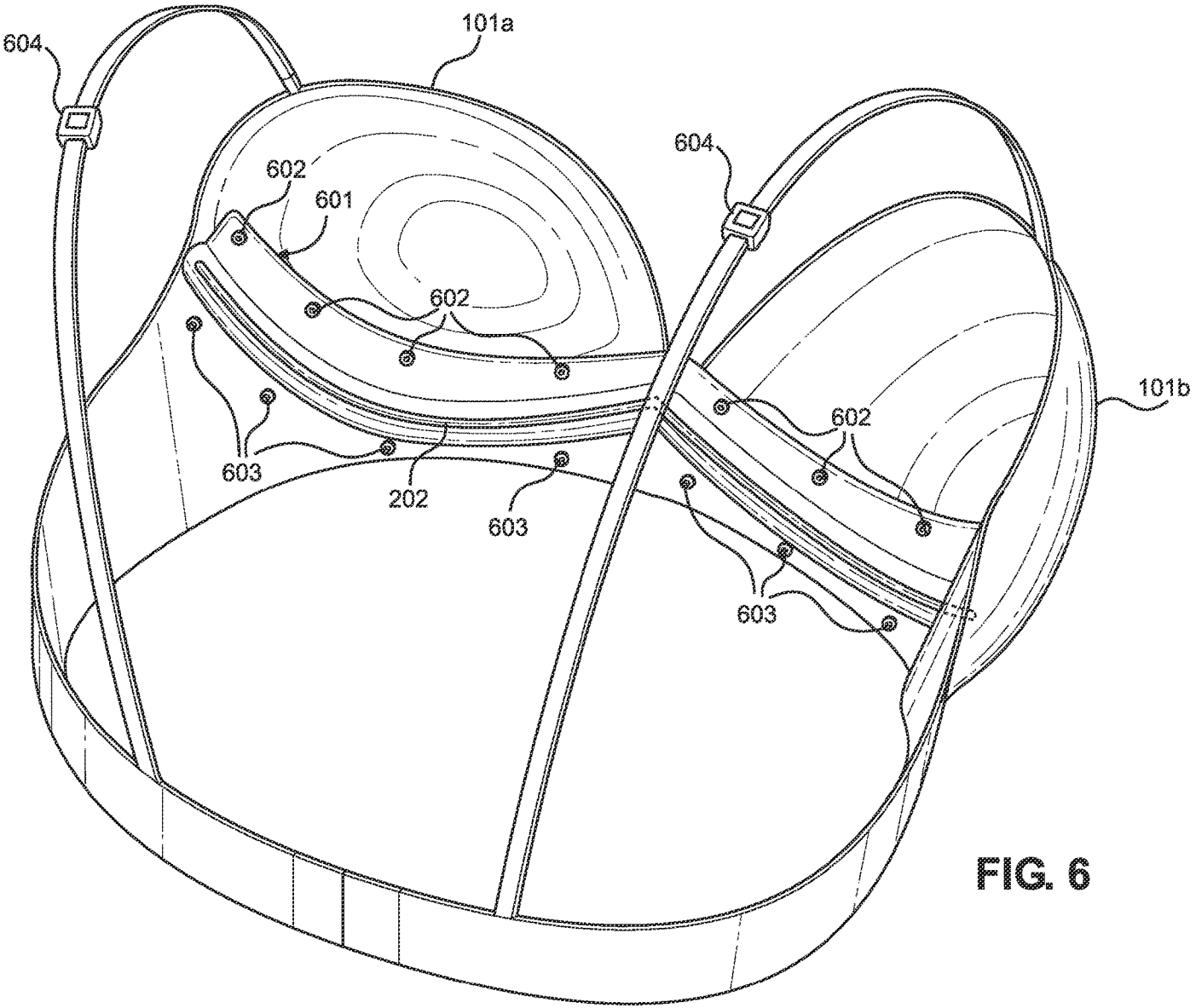
FIG. 6 shows a rear perspective view of an embodiment of the clothing article for breast support with removable underwire with tube for the underwire with a snap closure.

Referring now to FIG. 6, there is shown a rear perspective view of an embodiment of the clothing article for breast support with removable underwire with tube for the underwire with a snap closure. In some embodiment the underwire 202 is held in to the bra with snap closures. In other embodiments the is a separate underwire in each breast portion 101*a*, 101*b*. Snap closures will include a female snap portion 602 and a male snap portion 603. The male snap portion 603 is configured to frictionally engage with the female snap portion 602 and hold the underwire 202 in the bra. In one embodiment there is a flap 601. The flap 601 will fold over the underwire 202 securing it in place. The flap 601 will further prevent the underwire 202 from contacting the skin of the wearer.

In one embodiment the clothing article has adjustable shoulder straps. In one embodiment the shoulder straps are adjusted with an adjuster 604. This will allow the article to be adjusted to fit many different individuals. In one embodiment the adjuster 604 is a slide adjuster. This will allow the adjuster 604 to slide along the shoulder strap pulling a portion of the strap with it. This will lengthen or shorten the shoulder strap.

Figure 7:
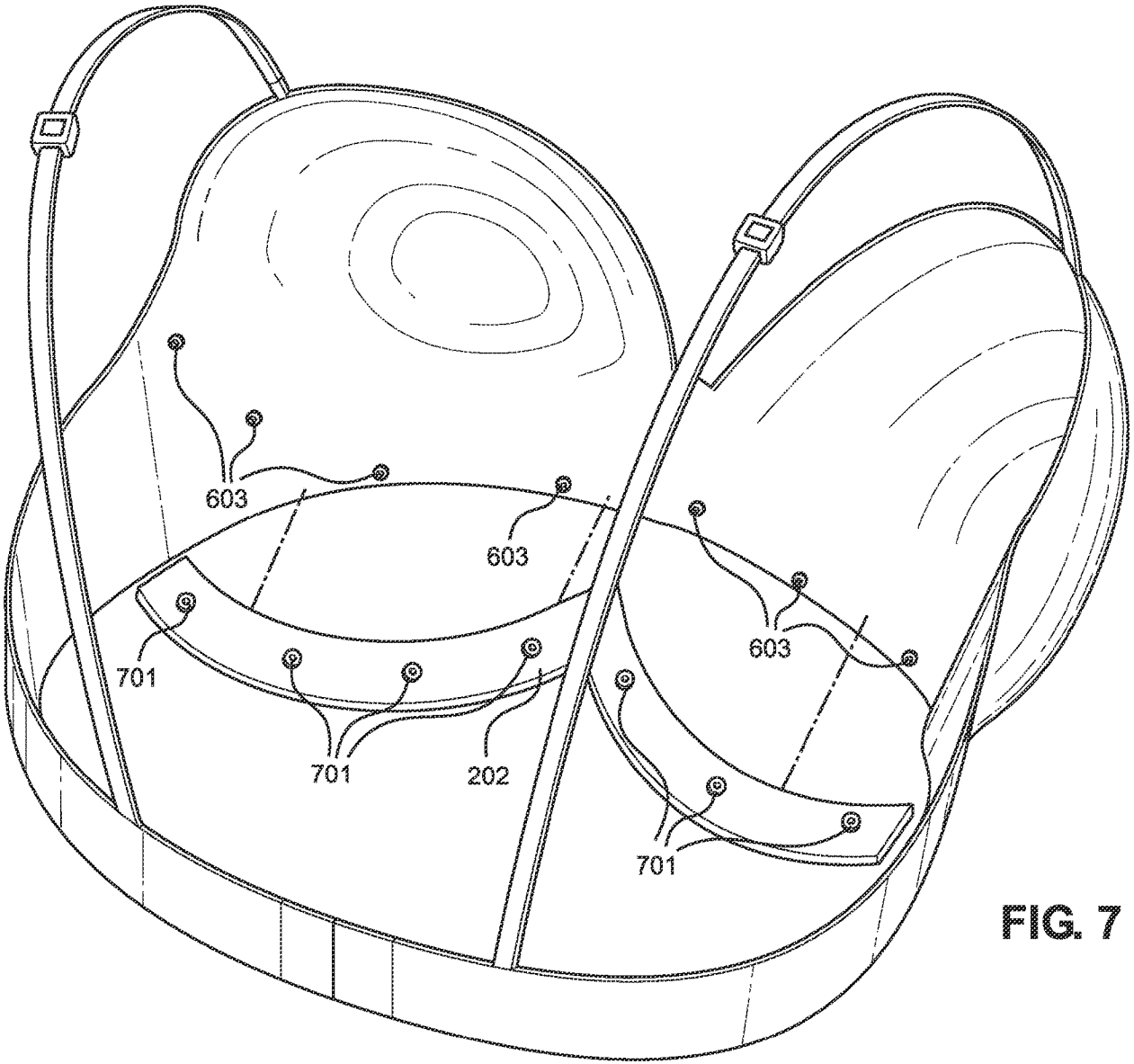
FIG. 7 shows a rear perspective view of an embodiment of the clothing article for breast support with removable underwire with a snap in underwire.

Referring now to FIG. 7, there is shown a rear perspective view of an embodiment of the clothing article for breast support with removable underwire with a snap in underwire. In the shown embodiment there is a plurality of male snap portions 603 located along the interior of the clothing article. In the underwire 202 has a plurality of female snap portions 701 located thereon. This will allow the underwire to be secured to the article via snaps. This will enable a user to easily remove or secure the underwire to the article as desired.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothing article for breast support with removable underwire, the article comprising: a front portion having two breast support sections; a pair of underwires removably secured in a tube located along a lower perimeter of each of the two breast support sections;

wherein each tube includes a fastener extending along a longitudinal axis of each tube, the fastener configured to selectively close an opening disposed alone a length of each tube;

a strap system secured to the top of each of the breast support sections; the strap system is further secured to a side of each breast support, wherein the straps are connected to opposite sides of each breast support section;

wherein the fastener comprises a hook and loop fastener; wherein the tube is defined by a flap affixed at a proximal edge to the lower portion, wherein the hook and loop fastener is disposed on a distal edge of the flap.

2. The clothing article for breast support with removable underwire of claim 1, wherein each underwire is made from metal.

3. The clothing article for breast support with removable underwire of claim 1, wherein each underwire is made from plastic.

4. The clothing article for breast support with removable underwire of claim 1, wherein each tube has at least one open end.

5. The clothing article for breast support with removable underwire of claim 1, wherein the fastener comprises a zipper.

6. The clothing article for breast support with removable underwire of claim 1, further comprising padding located within each breast support section.

7. The clothing article for breast support with removable underwire of claim 1, wherein the strap system includes a pair of shoulder straps and a chest strap.

8. The clothing article for breast support with removable underwire of claim 1, wherein each opposing end of the tube is closed.

9. The clothing article for breast support with removable underwire of claim 1, further comprising a pocket disposed in each breast portion, wherein the pocket is dimensioned to removably secure a pad therein.

* * * * *